US008032973B2

(12) United States Patent
Lutgen et al.

(10) Patent No.: US 8,032,973 B2
(45) Date of Patent: Oct. 11, 2011

(54) LIQUID APPLICATOR

(75) Inventors: Joseph Leon Lutgen, Huntersville, NC (US); Robin E. Smith, Stanley, NC (US); Brandon Cory Hoover, Cornelius, NC (US); Brandon Seth Cross, Huntersville, NC (US); George Andrew Hartel, Cornelius, NC (US); Matthew Shute, Charlotte, NC (US)

(73) Assignee: Newell Operating Company, Huntersville, NC (US)

( * ) Notice: Subject to any disclaimer, the term of this patent is extended or adjusted under 35 U.S.C. 154(b) by 998 days.

(21) Appl. No.: 11/879,734

(22) Filed: Jul. 17, 2007

(65) Prior Publication Data

US 2008/0189892 A1 Aug. 14, 2008

Related U.S. Application Data

(60) Provisional application No. 60/901,212, filed on Feb. 12, 2007.

(51) Int. Cl.
*B05C 17/00* (2006.01)

(52) U.S. Cl. ..... 15/210.1; 15/144.2; 15/244.2; 401/25

(58) Field of Classification Search ..... 15/210.1, 15/144.2, 144.1, 145, 209.1, 143.1, 172, 15/244.2; 401/264, 193, 25
See application file for complete search history.

(56) References Cited

U.S. PATENT DOCUMENTS 2,086,956 A 7/1937 Long
2,156,270 A 5/1939 Smith
2,625,702 A 1/1953 Grubbs
3,369,268 A 2/1968 Burns et al.
3,414,929 A 12/1968 Warner et al.
3,464,079 A 9/1969 Palmeri
3,473,183 A 10/1969 Burns et al.
3,484,795 A 12/1969 Nicolay
3,599,265 A 8/1971 D'Ercoli et al.
3,605,165 A 9/1971 Burns
3,629,894 A 12/1971 Stefany
3,708,821 A 1/1973 Chase et al.
3,714,675 A 2/1973 Koptelow
3,717,896 A 2/1973 Chase et al.
3,722,019 A 3/1973 Magnien
3,728,755 A 4/1973 Whalen
3,736,616 A 6/1973 Seip
3,918,820 A 11/1975 Kim
4,033,010 A * 7/1977 McCalla ..... 16/422
D249,821 S 10/1978 Cooke et al.
4,127,911 A 12/1978 Cupp et al.
4,155,140 A 5/1979 Janssen et al.
4,244,074 A 1/1981 Barcikowski et al.
4,300,258 A 11/1981 Burns et al.
D268,891 S 5/1983 Derloshon, Jr.
4,424,603 A 1/1984 Balint et al.
4,554,699 A 11/1985 Simmons
4,631,019 A 12/1986 House
4,658,461 A * 4/1987 Roe et al. ..... 15/210.1
4,674,144 A 6/1987 Palmeri (Continued)

*Primary Examiner* — Shay Karls
(74) *Attorney, Agent, or Firm* — Taft Stettinius & Hollister LLP

(57) ABSTRACT

A coating applicator comprising a substrate removably mounted to a frame, where the frame includes an actuator repositionable between an engaging position and a disengaging position, where the engaging position is operative to maintain the substrate in mounting engagement with the frame, where the disengaging position is operative to discontinue the substrate in mounting engagement with the frame, and where the substrate includes a receptor for retaining a coating composition for application.

18 Claims, 14 Drawing Sheets

U.S. PATENT DOCUMENTS

| | | | | |
|---|---|---|---|---|
| 4,729,143 | A | 3/1988 | Dawson | |
| 4,819,294 | A | 4/1989 | Calvert | |
| 4,829,623 | A | 5/1989 | Brezette et al. | |
| 4,852,203 | A | 8/1989 | LaBelle | |
| 5,117,527 | A | 6/1992 | Milkie | |
| 5,134,745 | A * | 8/1992 | Burns et al. | 15/210.1 |
| 5,209,781 | A | 5/1993 | Milkie | |
| 5,267,369 | A | 12/1993 | O'Neil et al. | |
| 5,331,710 | A | 7/1994 | Tollasepp | |
| 5,386,610 | A | 2/1995 | Batanjski | |
| 5,432,972 | A | 7/1995 | Polzin et al. | |
| 5,443,533 | A * | 8/1995 | Magnien | 15/210.1 |
| 5,495,635 | A | 3/1996 | Williams | |
| 5,556,470 | A | 9/1996 | Gruber | |
| 5,640,737 | A | 6/1997 | Boggs | |
| 5,678,277 | A | 10/1997 | Sorenson | |
| D394,958 | S | 6/1998 | Polzin et al. | |
| 5,822,823 | A | 10/1998 | Polzin et al. | |
| 5,933,905 | A | 8/1999 | Hess | |
| 6,076,225 | A | 6/2000 | Sorenson | |
| D439,748 | S | 4/2001 | Woodnorth et al. | |
| 6,272,715 | B1 | 8/2001 | Polzin et al. | |
| 6,305,043 | B1 * | 10/2001 | Rosnak | 15/144.2 |
| 6,530,107 | B2 | 3/2003 | Kim | |
| 6,554,902 | B2 | 4/2003 | Yan | |
| D474,031 | S | 5/2003 | Wassil et al. | |
| 6,622,884 | B1 | 9/2003 | Gartner | |
| 6,634,525 | B2 | 10/2003 | Bravo et al. | |
| D482,202 | S | 11/2003 | Newman et al. | |
| 6,776,548 | B2 | 8/2004 | Gardner, Jr. et al. | |
| 6,865,769 | B1 | 3/2005 | Sorenson | |
| D504,777 | S | 5/2005 | Gartner | |
| D510,812 | S | 10/2005 | Bortz | |
| D515,821 | S | 2/2006 | Gartner | |
| 7,028,363 | B1 | 4/2006 | Gartner | |
| D527,190 | S | 8/2006 | Henke et al. | |
| 7,111,354 | B2 | 9/2006 | Nennig et al. | |
| 7,182,505 | B2 | 2/2007 | Huckby | |

* cited by examiner

LIQUID APPLICATOR

CROSS REFERENCE TO RELATED APPLICATIONS

The present application claims the benefit under 35 U.S.C. §119 to U.S. Provisional Patent Application Ser. No. 60/901,212, filed Feb. 12, 2007 and titled "PAINT EDGER," the disclosure of which is hereby incorporated by reference.

INTRODUCTION TO THE INVENTION

Field of the Invention

The present invention is directed to devices for applying liquids to substrates and, more specifically, to devices for use in applying paint.

It is a first aspect of the present invention to provide an applicator comprising: (a) a frame including a lateral detent, the lateral detent being repositionable between an extended position and a retracted position; (b) a substrate removably mounted to the frame, the substrate including a first edge generally perpendicular to a second edge, and the substrate including a lateral detent receiver approximate the second edge for selectively receiving the lateral detent when the lateral detent is in the extended position; and (c) a turret rotationally mounted to the frame to allow rotation of the turret independent of the frame, where at least one of the frame and the turret includes an actuator for repositioning the lateral detent from the extended position and to the retracted position.

In a more detailed embodiment of the first aspect, the turret includes the actuator for repositioning the lateral detent from the extended position and to the retracted position. In yet another more detailed embodiment, the lateral detent comprises a pair of opposed lateral detents, the turret includes the actuator, and the lateral detents comprise opposed lateral ends of a deformable panel. In a further detailed embodiment, the deformable panel slidably engages a track on the underside of the frame, the deformable panel is repositionable between a substantially planar orientation and a substantially bowed orientation, the substantially planar orientation corresponds to the extended position, and the substantially bowed orientation corresponds to the retracted position. In still a further detailed embodiment, the deformable panel includes an orifice for receiving a portion of the actuator to mount the turret to the deformable panel. In a more detailed embodiment, the invention further includes a repositionable guide mounted to the frame, the repositionable guide being repositionable between an edging position and a withdrawn position, the repositionable guide including at least one guide wheel extending beyond the guide. In a more detailed embodiment, the frame and turret cooperate to provide a ratchet comprising a toothed wheel engaged and a catch for engaging at least one tooth of the toothed wheel. In another more detailed embodiment, the substrate includes a lateral upstanding loop the cooperates with a base of the substrate to provide the detent receiver. In yet another more detailed embodiment, the turret includes a finger grip, and the turret includes a proximal finger indentation. In still another more detailed embodiment, the turret is pivotally coupled to a threaded shaft receiver, the turret is rotationally repositionable about a first axis, the threaded shaft receiver is rotationally repositionable about a second axis, the first axis is substantially perpendicular to the second axis.

It is a second aspect of the present invention to provide an applicator comprising: (a) a frame including a substantially planar underside, the frame also including a receiver, an actuator, and a turret; (b) a substrate removably mounted to the substantially planar underside of the frame, the substrate including a liquid application surface having a first lateral edge generally perpendicular to a second lateral edge; and (c) a guide including a straight edge and a guide wheel, the guide being repositionably mounted to the receiver and repositionable by way of the actuator between an edging position and a withdrawn position, the guide cooperating with the frame when the guide is in the edging position to form an L-shaped feature adjacent to the substrate when mounted to the frame, the guide wheel extending outward beyond the straight edge to backset the straight edge from an adjacent surface contacting the guide wheel.

In a more detailed embodiment of the second aspect, the frame includes a lateral detent, the lateral detent being repositionable between an extended position and a retracted position, the turret includes a detent actuator for repositioning the lateral detent from an extended position to a retracted position, and the substrate including a lateral detent receiver. In yet another more detailed embodiment, the lateral detent comprises a pair of opposed lateral detents, the substrate comprises a pair of lateral detent receivers, and the lateral detents comprise opposed lateral ends of a deformable panel mounted to the frame. In a further detailed embodiment, the deformable panel slidably engages a track on the underside of the frame, the deformable panel is repositionable between a substantially planar orientation and a substantially bowed orientation, the substantially planar orientation corresponds to the extended position, and the substantially bowed orientation corresponds to the retracted position. In still a further detailed embodiment, the deformable panel includes an orifice for receiving a portion of the actuator to mount the turret to the deformable panel. In a more detailed embodiment, the turret is rotationally mounted to the frame to allow rotation of the turret independent of the frame, the frame and turret cooperate to provide a ratchet comprising a toothed wheel engaged and a catch for engaging at least one tooth of the toothed wheel. In a more detailed embodiment, the substrate includes a lateral upstanding loop that cooperates with a base of the substrate to provide the detent receiver. In another more detailed embodiment, the turret includes a finger grip, and the turret includes a proximal finger indentation. In yet another more detailed embodiment, the turret is pivotally coupled to a threaded shaft receiver, the turret is rotationally repositionable about a first axis, the threaded shaft receiver is rotationally repositionable about a second axis, and the first axis is substantially perpendicular to the second axis.

It is a third aspect of the present invention to provide an applicator frame comprising: (a) a frame including a substantially planar underside and adapted to have a removable painting pad mounted thereto, the frame also including a receiver and an actuator; (b) a guide repositionably mounted to the receiver and repositionable by way of the actuator between an edging position and a withdrawn position, the guide including a straight edge and a guide wheel extending beyond the straight edge when in the guide is in the edging position to backset the straight edge from an adjacent surface contacting the guide wheel, and (c) a turret rotationally mounted to the frame to allow rotation of the turret independent of the frame.

In a more detailed embodiment of the third aspect, the guide is rotationally repositionable with respect to the receiver, the frame includes a substantially linear guide along which the actuator is repositionable, and the actuator is operatively coupled to the guide. In yet another more detailed embodiment, the straight edge comprises multiple straight edge segments, the guide includes a tubular portion having opposing ends, and at least two straight edge segments are mounted to each opposing end of the tubular portion.

DETAILED DESCRIPTION

Figure 1:
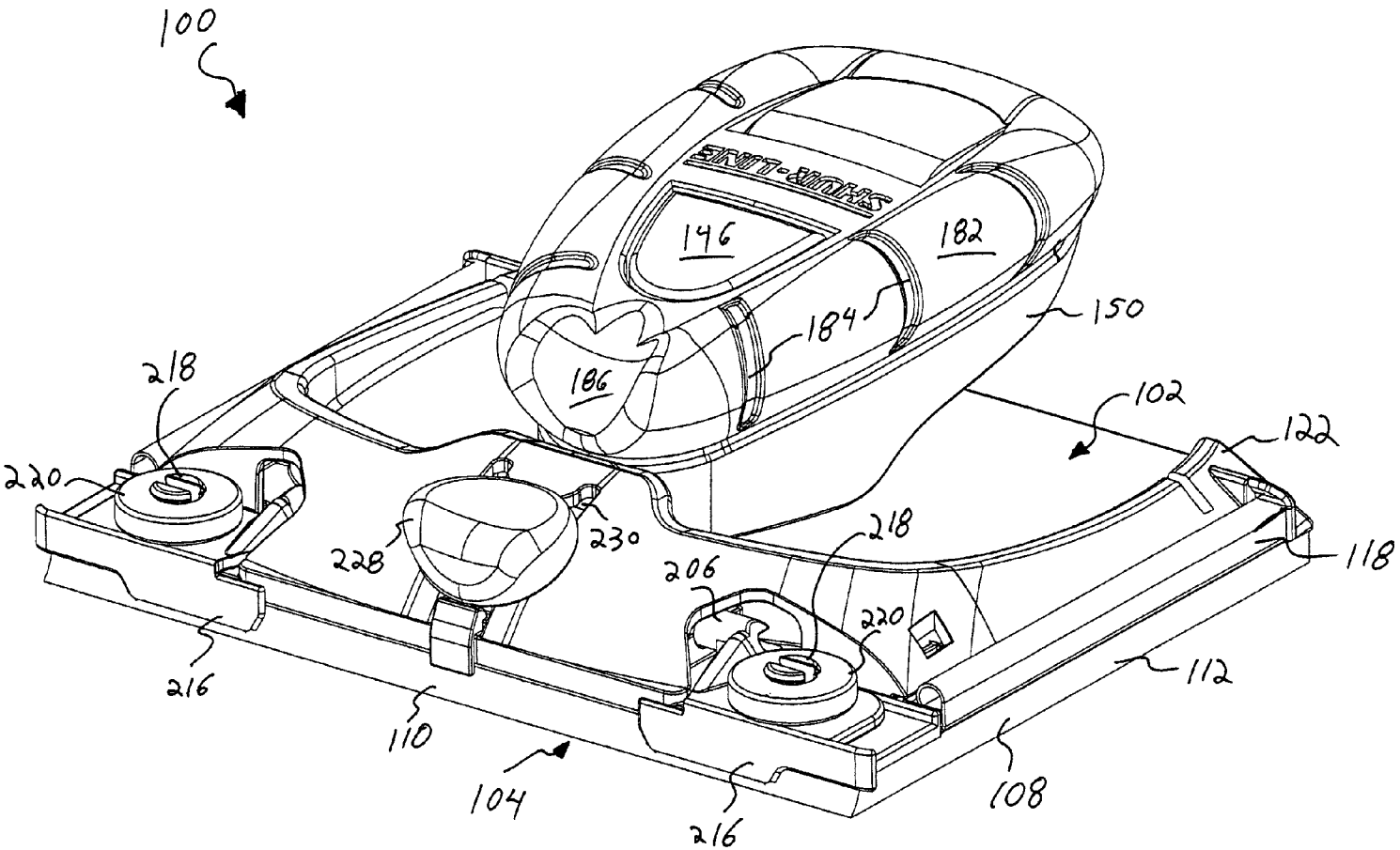
FIG. 1 is an elevated perspective view of an exemplary liquid applicator in accordance with the present invention, where a guide assembly is in the edging position.

The exemplary embodiments of the present invention are described and illustrated below to encompass devices utilized in liquid applications such as, without limitation, painting applications. Of course, it will be apparent to those of ordinary skill in the art that the preferred embodiments discussed below are exemplary in nature and may be reconfigured without departing from the scope and spirit of the present invention. However, for clarity and precision, the exemplary embodiments as discussed below may include optional steps, methods, and features that one of ordinary skill should recognize as not being a requisite to fall within the scope of the present invention.

Referencing FIGS. 1-5, an exemplary liquid applicator 100 includes a reusable structure 102 and a disposable structure 104 for applying a liquid to a chosen surface, such as, without limitation, an interior wall of a building. In exemplary form, the liquid applicator 100 is particularly suited for painting applications and, even more so, for painting borders. In the painting arena, painting of borders around windows, doorways, and adjacent walls is initially done before the larger, remaining surfaces are painted.

The exemplary disposable structure 104 includes a plastic backing 106 and a carpet 108 sheet glued to the backing. The carpet 108 includes a plurality of upstanding fibers (not shown) that are adapted to retain the paint until the carpet is positioned against the surface to be painted. The backing 106 and carpet 108 define a generally rectangular painting area having a forward linear edge 110 and opposed lateral edges 112, 114 that are perpendicular to the forward linear edge 110. It is to be understood, however, that the backing 106 and carpet 108 may exhibit shapes other than rectangular such as, without limitation, triangular, hexagonal, and T-shaped. It is also to be understood that the opposed lateral edges 112, 114 need not be perpendicular to the forward linear edge 110. A backside surface 116 of the backing 106 includes a pair of upstanding loops 118 longitudinally extending approximate the lateral edges 112, 114. Each loop 118 cooperates with the backside surface 116 to define a longitudinally extending groove 120. As will be discussed in more detail below, this groove 120 operates to couple the disposable structure 104 to the reusable structure 102.

The exemplary reusable structure 102 includes a molded frame 122 to which a turret assembly 124, an ejector assembly 126, and a guide assembly 128 are mounted. Exemplary methods to mold the frame 122 include, without limitation, plastic injection molding. The underside 130 of the frame 122 is substantially planar to receive and apply substantially equal pressure to the plastic backing 106 of the disposable structure 104 during painting. Opposing pairs of guides 132 cooperate with the underside 130 of the frame 122 to provide a track 134 which receives a deformable panel 136 of the ejector assembly 126.

The ejector assembly 126 is operative to retain the disposable structure 104 during painting and selectively disengage the disposable structure 104 subsequent to painting. The deformable panel 136 comprises a rectangular plastic sheet having a generally centered orifice 138 to receive a projection 140 that extends through a cavity 142 within the frame 122. One end of the projection 140 includes a pair of opposed detents 144 for mounting the panel to the projection, while also allowing the projection to rotate with respect to the panel 136. However, for purposes of the instant invention, the projection need not be allowed to rotate with respect to the panel 136. An opposed end of the projection 140 is integrally attached to an actuator 146 that extends through a corresponding cavity 148 formed within a turret 150 of the turret assembly 124. Pushing the actuator 146 downward and into the corresponding cavity 148 forces the projection 140 against the panel 136, causing the panel to deform from a substantially planar position to a substantially bowed position (see FIGS. 3 & 4). This deformation also causes the ends 154, 156 of the panel 136 to be drawn inward toward the lateral sides 158, 160 of the frame so that the ends of the panel become substantially flush with the lateral sides of the frame.

Figure 3:
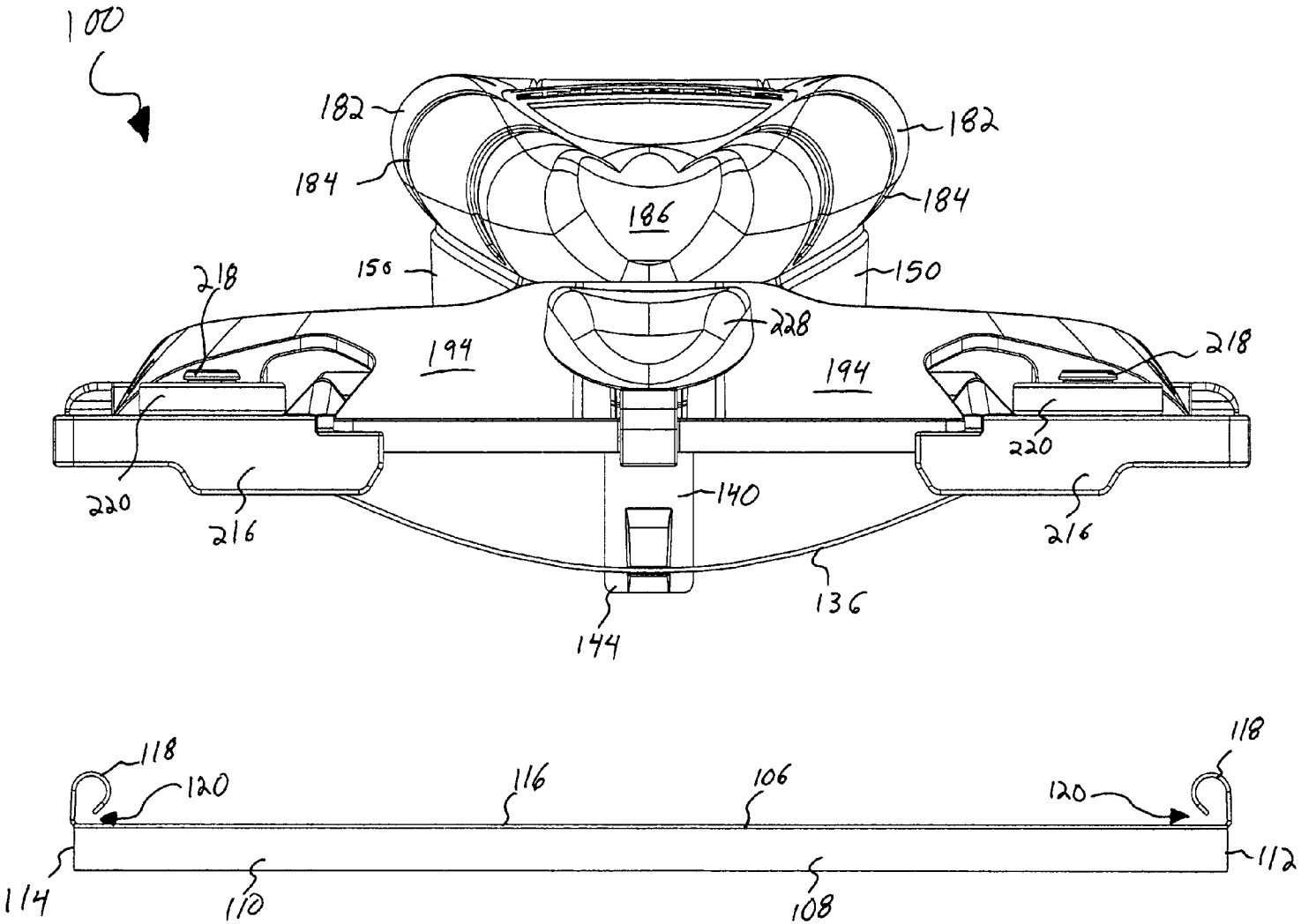
FIG. 3 is a frontal view of an exemplary liquid applicator showing separation between respective structures of the applicator.
Figure 4:
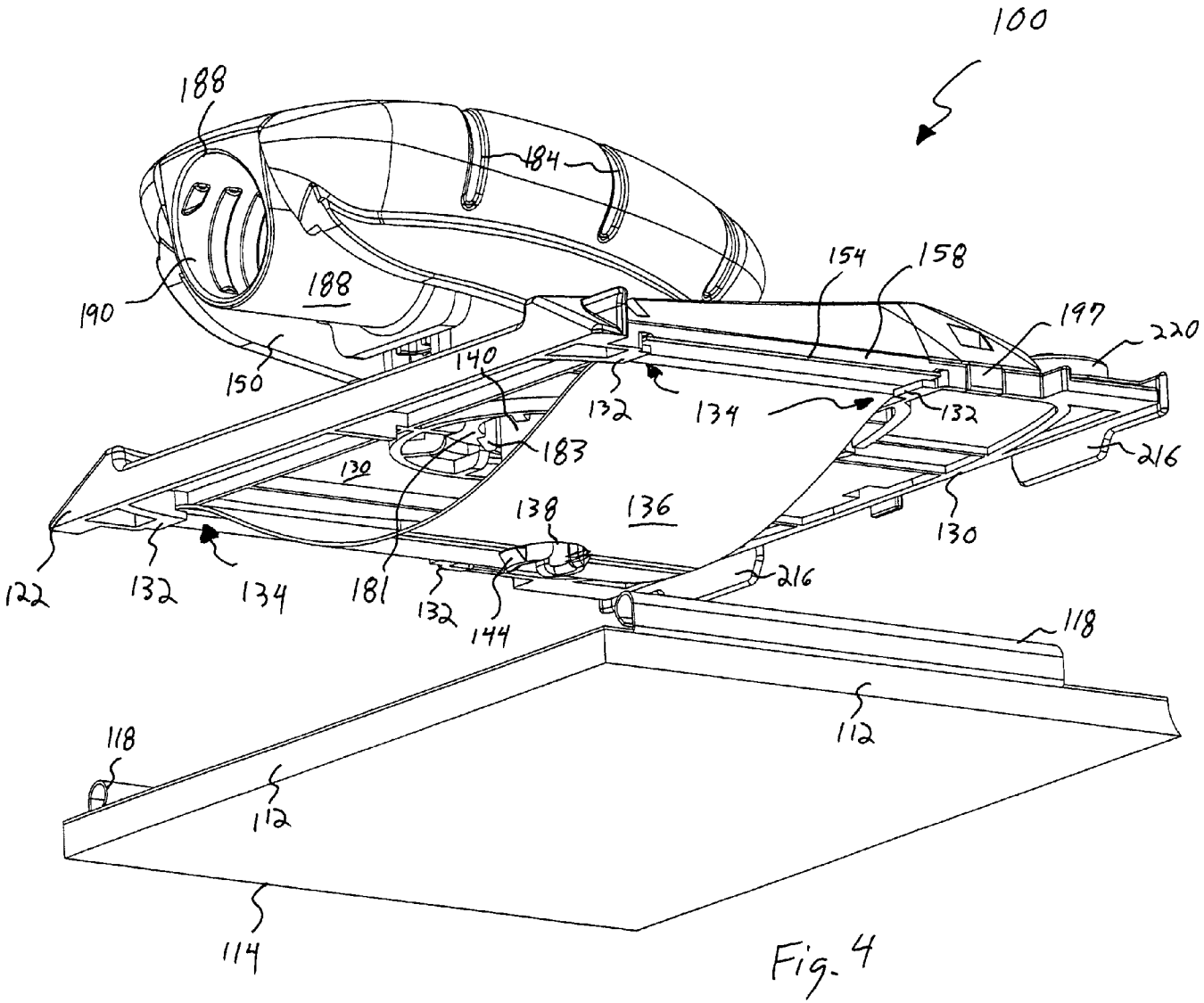
FIG. 4 is a recessed perspective view of the exemplary liquid applicator of FIG. 3.
Figure 5:
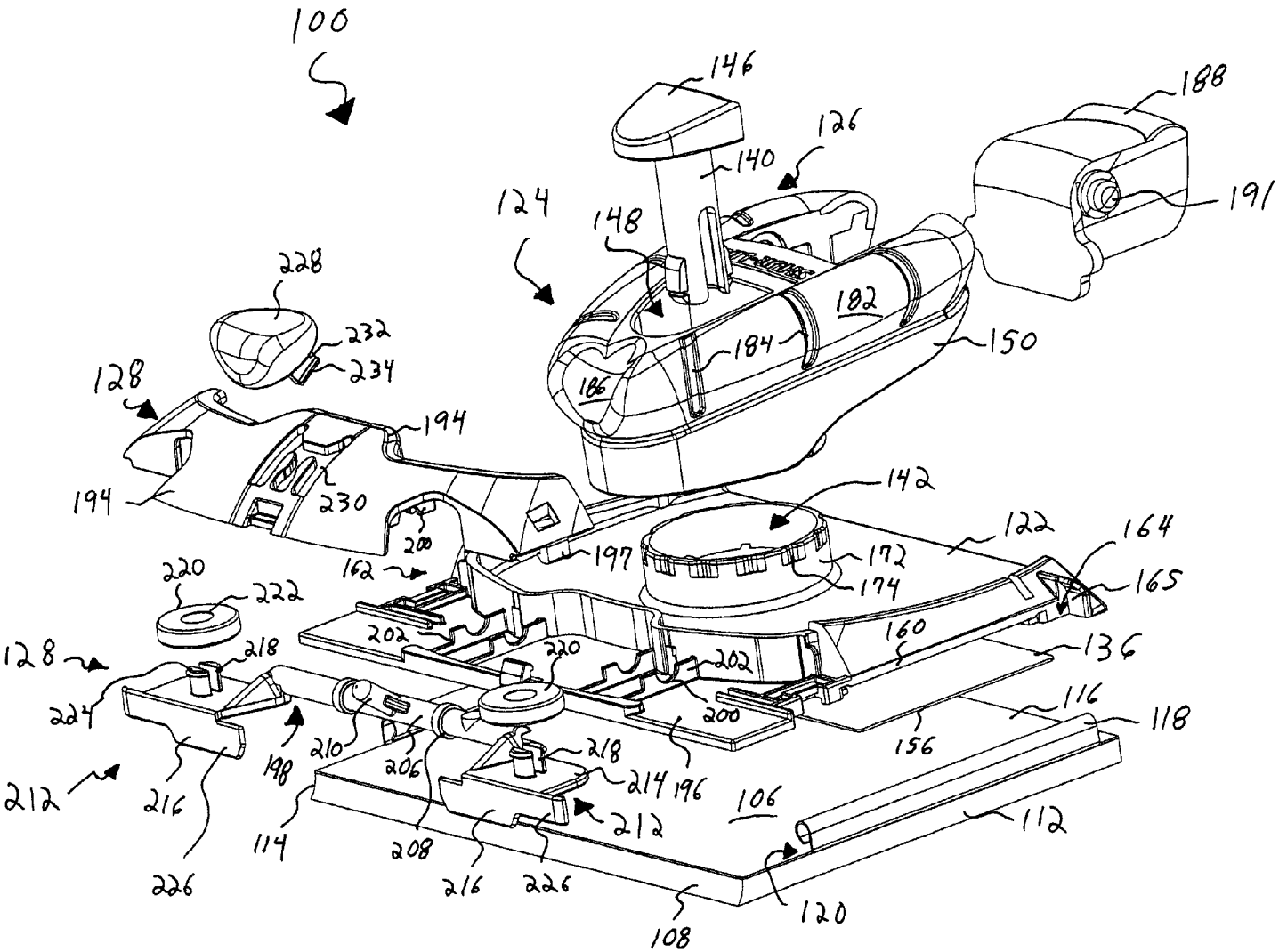
FIG. 5 is an exploded view of the exemplary liquid applicator of FIG. 1.
Figure 6:
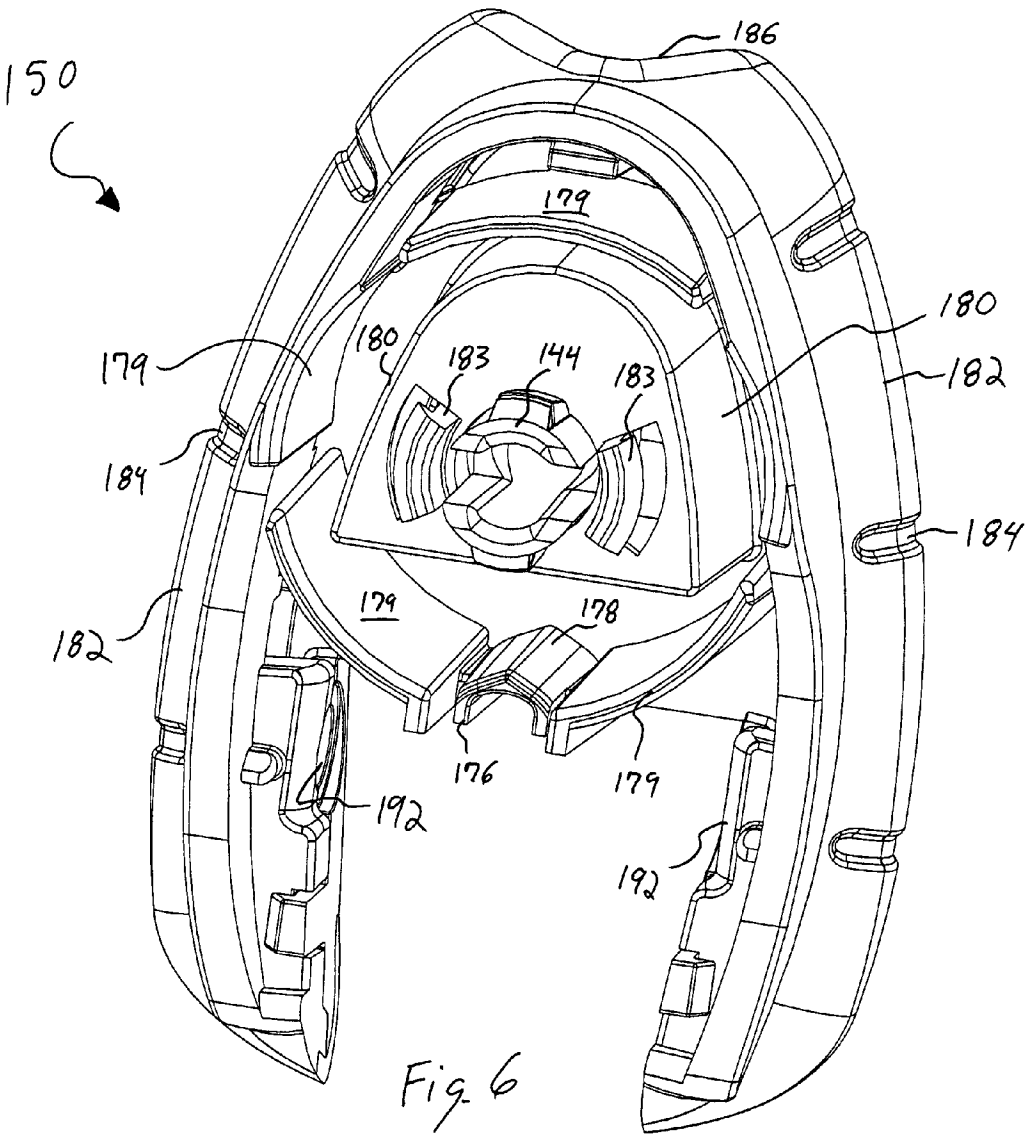
FIG. 6 is an underneath view of an exemplary turret, without the frame, in accordance with the present invention.
Figure 7:
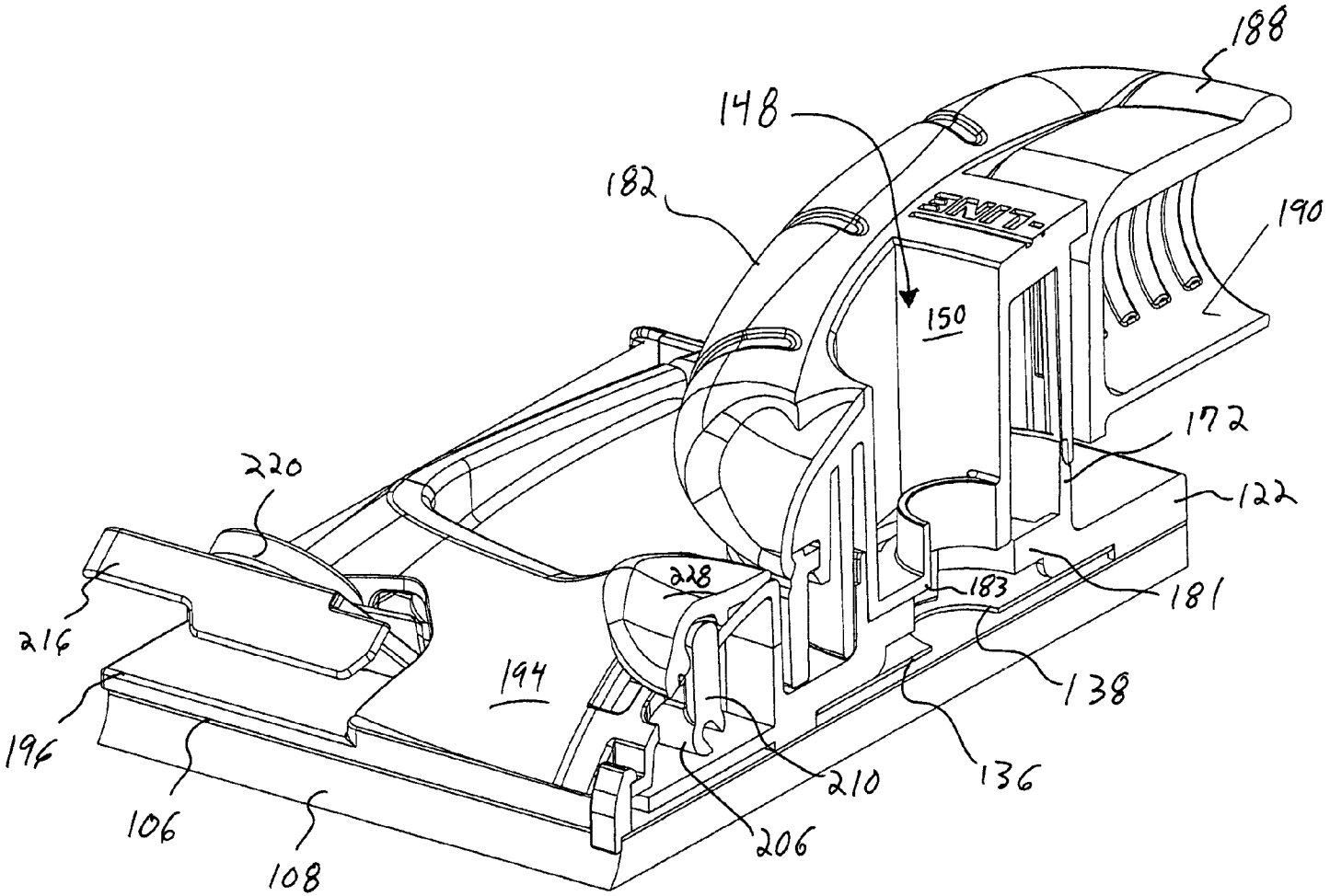
FIG. 7 is an elevated perspective view of a cross-section of the exemplary liquid applicator of FIG. 2.
Figure 8:
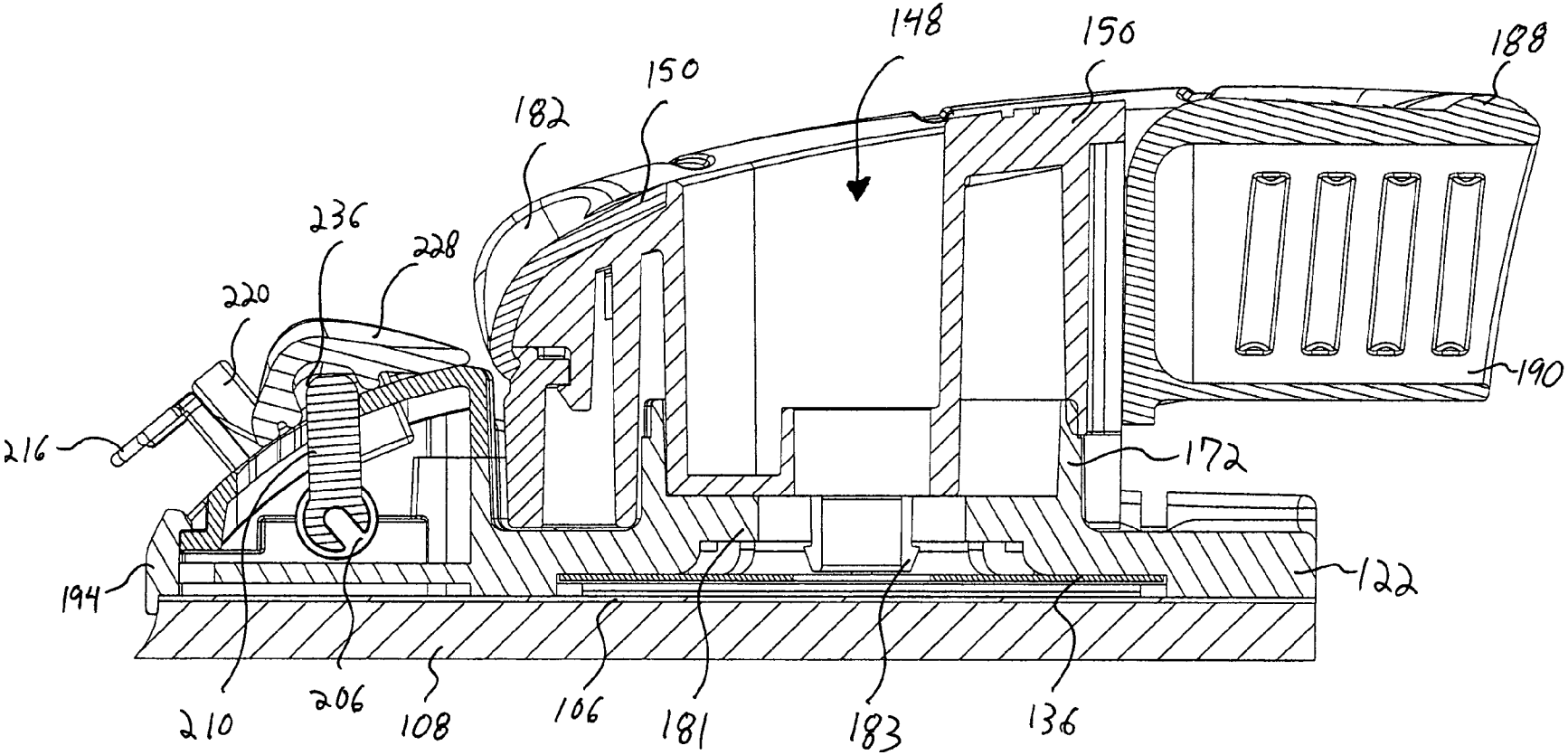
FIG. 8 is a cross-sectional view of the exemplary liquid applicator of FIG. 2.
Figure 9:
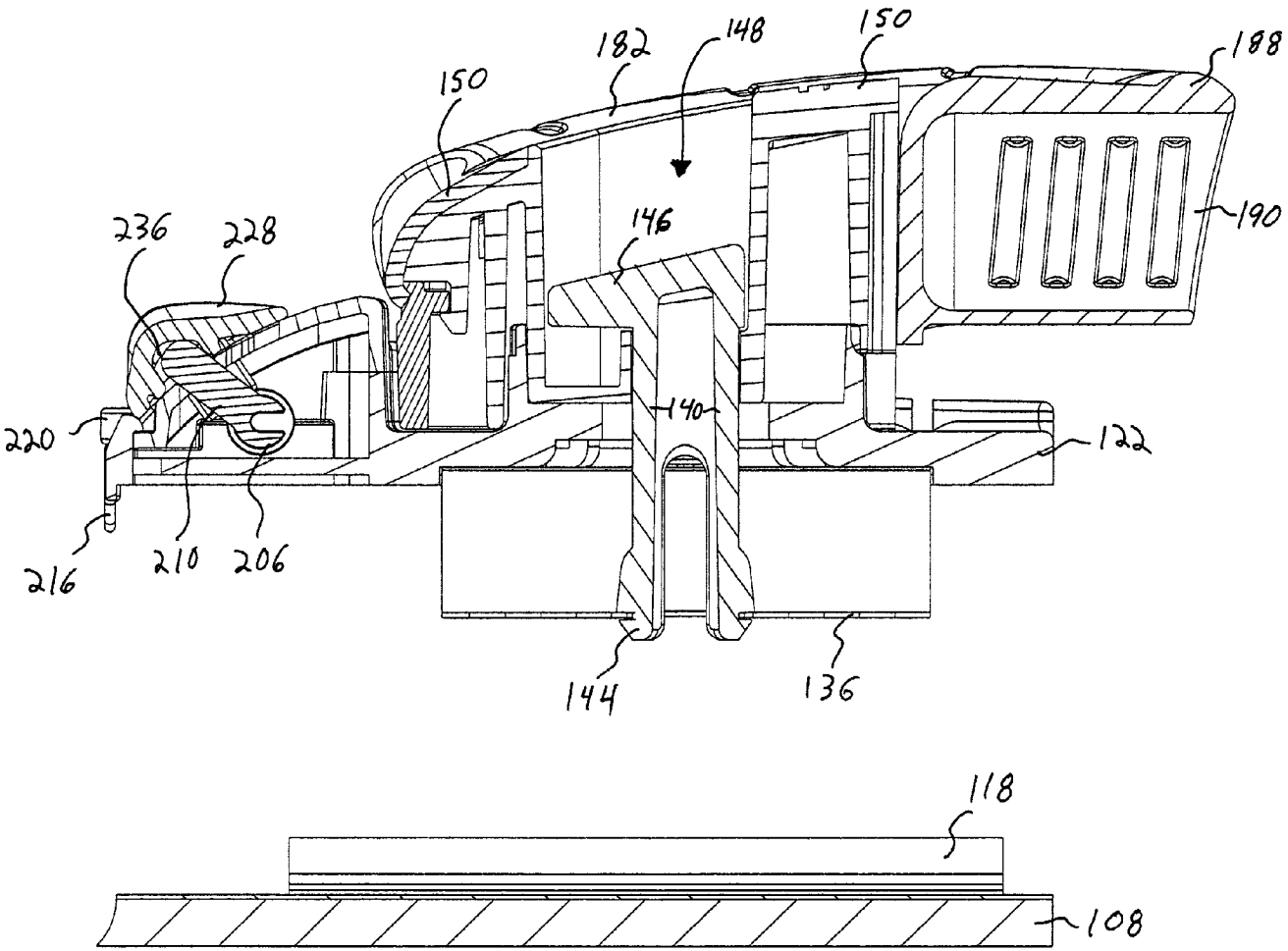
FIG. 9 is a cross-sectional view of the exemplary liquid applicator of FIG. 1.

Referring to FIGS. 3-5, joining the reusable structure 102 to the disposable structure 104 includes aligning the reusable structure over the disposable structure so each upstanding loop 118 of the plastic backing 106 is aligned with a corresponding lateral cavity 162, 164 on each lateral side 154, 156 of the frame 122. A pair of angled guides 165 project from each lateral side 154, 156 of the frame 122 to help facilitate alignment of the reusable structure 102 with respect to the disposable structure 104. This initially includes vertically orienting each upstanding loop 118 of the plastic backing 106 generally within each of the corresponding lateral cavities 162, 164 of the frame 122. When this general orientation is reached, the reusable structure 102 and the disposable structure 104 are brought closer to one another so that any misalignment is corrected by one or both loops 118 contacting the angled guides 165, which direct the loops 118 into proper orientation within the lateral cavities 162, 164 as the structures 102, 104 continue to be brought closer to one another. In this exemplary embodiment, misalignment refers to a condition where the front of the disposable structure 104 is not aligned with the front of the reusable structure 102. Thus, the angled guides 165 ensure that the front of the disposable structure 104 is aligned with the front of the reusable structure 102 by pushing the disposable structure 104 forward by way of the loops 118. When the ends 154, 156 of the panel 136 are extended outward from the lateral sides 158, 160 of the frame, the ends provide deformable flanges that are repositionable by lateral movement in or out. By bringing the upstanding loop 118 of the plastic backing 106 into contact with the ends 154, 156 of the panel 136, the ends move laterally inward, while the loops deform slightly outward, thereby allowing vertical travel of a corresponding end against a corresponding loop. The rounded or contoured upper surface of each loop 118 also operates to facilitate vertical sliding of the ends 154, 156. Eventually, the ends 154, 156 of the panel 136 pass beyond the edge of the loops 118 and into the longitudinally extending groove 120. In this manner, each loop 118 is utilized to retain the ends 154, 156 of the panel 136 within the longitudinal groove 120. In exemplary form, a user may desire to remove the disposable structure 104 from the reusable structure 102, at which point the sharp edge at the end of each loop 118 would no longer retain the ends 154, 156 of the panel 136 within the longitudinal groove 120.

Removal of the disposable structure 104 from the reusable structure 102 includes deforming the panel 136 so that the ends 154, 156 are drawn laterally inward and beyond the ends of both loops 118. An exemplary process to accomplish this result includes depressing the actuator 146, integrally coupled to the projection 140, to vertically reposition the projection downward through the cavity 142 within the frame 122. This downward movement of the projection 140 is transferred to the panel 136, causing the panel to deform from a substantially planar position to a substantially bowed position (see FIG. 4). Deformation of the panel 136, while the panel remains within the track 134, causes the ends 154, 156 of the panel 136 to be drawn laterally inward so that the ends of the panel become substantially flush with the lateral sides of the frame. Concurrent with the movement of the ends 154, 156 of the panel 136, downward movement of the projection 140 causes the projection to contact the plastic backing 106 of the disposable structure 104. Continued downward movement of the projection 140 pushes the central region of the disposable structure away from the frame 122. In this exemplary embodiment, the disposable structure 104 is fabricated from a flexible and resilient plastic backing 106 that bows outward under the pressure applied by the projection 140. Thus, downward movement of the projection is concurrently able to retract the ends 154, 156 of the panel 136 and force the disposable structure 104 away from the frame 122 of the reusable structure 102. The resilient properties of the backing 106 essentially form a spring having a corresponding spring force when the backing is bowed outward from the frame. When the ends 154, 156 of the panel 136 are retracted sufficiently out of the vertical line of travel of the loops 118, the spring force propels the disposable structure 104 away from the reusable structure 102, commonly referred to as ejecting the disposable structure 104 from the reusable structure 102.

Referring to FIGS. 1-6, the turret assembly 124 of the exemplary liquid applicator 100 includes the turret 150 that is rotationally repositionable about a vertical axis extending through an upstanding circular ring 172 of the frame 122. The upstanding circular ring 172 includes a plurality of repeating depressions 174, which in exemplary form are V-shaped, spaced apart on a circumferential exterior surface, where the depressions 174 may be engaged by a corresponding projection 176 on the underside of the turret 150. The projection 176 includes a head 178, which in exemplary form is arrow-shaped, that is received within one of the V-shaped depressions 174 to retain the turret 150 in a fixed orientation with respect to the frame 122. When a user desires to change the orientation of the turret 150 with respect to the frame 122, the user simple twists the turret 150, causing the projection 176 to flex outward from the respective V-shaped projection and ride upon the exterior circumferential surface of the circular ring 172.

The underside of the turret 124 also includes a series of arcuate guide rails 179 that define a circular interior region slightly larger (could be slightly smaller and occupy the inside) than the circular area occupied by the upstanding ring 172. In an alternate exemplary embodiment, the series of arcuate guide rails 179 could define a circular interior region slightly smaller than the circular area occupied by the upstanding ring 172, where the rails occupy the inside of the circular area. In either instance, the guide rails 179 set a boundary for movement between the turret 150 and ring 172, thereby allowing pivoting action between the two, but without providing significant lateral play. An semi-oval projection 180 extends from the underside of the turret 150 and occupies a portion of the interior region defined by the guide rails 179 and occupies an interior region of the circular ring 172 when the turret 150 is mounted to the frame 122. In exemplary form, the semi-oval projection 180 defines the corresponding cavity 148 that the actuator 146 and projection 140 travel within, which is generally centered within the circular interior region of the guide rails 179. Moreover, the semi-oval projection 180 is sized to have its longest lateral dimension being no greater than the diameter of the upstanding ring 172 so that rotation of the turret 150 will not be inhibited by the projection 180 binding against an interior wall of the circular ring 172. Recessed within the interior of the cavity 142 of the frame 122 is a ledge 181 that has a decreased diameter to allow throughput of the projection 140. A raised ring 187 prevents the actuator 146 from pushing the deformable panel 136 too far. If the ring 187 was not there, a user pushing on the actuator 146 would release the panel 132 from the tabs 132 and allow the panel 132 to fall from the edger base. Corresponding detents 183 extend from the underside of the turret 150 and lock onto the underside of the ledge 181 to inhibit upward movement of the turret 150 with respect to the frame 122, but still allow rotation about the central axis of actuator 146.

Referring to FIGS. 1-6, the turret 150 may be grasped by the hand of a user, or utilized as a female receiver for an extension shaft (not shown) to increase the operating range of the liquid applicator 100. Vertical ribs 184 are formed on the exterior of the grips 182. Generally, the grips 182 facilitate grasping of the turret 150 between the fingers and thumb of a user. A frontal portion of the grips 182 includes an indentation 186 for guiding your finger to guide control button 228. However, in those instances where hand gripping is not preferred, the user may utilize an adapter 188 pivotally mounted to the rear of the turret 150 to insert an extension shaft (not shown).

The adapter 188 includes a rearmost threaded cavity 190 which is adapted to receive a male threaded projection from the extension shaft. On each side of the adapter 188 are pins 191 that fit within corresponding circular openings 192 on the underside of the turret 150 to facilitate pivotal movement between the turret 150 and the adapter 188. In this exemplary embodiment, the adapter 188 pivots about a pivotal axis extending laterally through the pins 191 and perpendicular the pivotal axis about which the turret 150 pivots with respect to the frame 122. It is to be understood that the pivotal range of movement between the turret 150 and the frame 122 is approximately 180 degrees, however, it is also within the scope of the invention to provide 360 degrees of pivotal range, while the pivotal range of movement between the adapter 188 and the turret 150 is approximately 25 degrees. However, those skilled in the art will readily understand that the pivotal range of movement may be changed between any of the components without departing from the scope of the present invention.

Referencing FIG. 5, the guide assembly 128 of the exemplary liquid applicator 100 includes a guide housing 194 is mounted to a forward aspect 196 of the frame 122 using a pair of detents 197. The guide housing 194 and the forward aspect 196 of the frame 122 provide a tailored cavity at least partially occupied by the guide 198. Semicircular depressions 200 formed within ribs 202, 204 of the housing 194 and frame 122 cooperate to form circular openings occupied by a tubular portion 206 of the guide 198. This tubular guide portion 206 includes a pair of raised rings 208 that provide an alignment for a central lever 210. Each end of the tubular portion 206 includes a guide flap 212, which includes a base 214 and a straight edge 216 that cooperate to form a generally L-shaped feature. A cylindrical projection 218 extends upward from the base 214 and has mounted to it an optional roller wheel 220 that is pivotally repositionable about the projection. The roller wheel 220 is mounted to the projection 218 by overlapping a central orifice 222 of the roller wheel with detents 224 of the projection 218, followed by downward movement of the wheel toward the detents so that the angle edges of the detent are contacted by the circumferential edges defining the central orifice 222. This contact forces the angled detent edges toward one another so that the diameter of the detents 224 is less than the diameter of the central orifice 222, thereby allowing the detents 224 to pass through the orifice 222 and thereafter spread apart. The underneath shape of the detents 224, combined with the spreading apart action, inhibits removal of the wheel 220 from the projection 218, but allows rotational repositioning of the wheel with respect to the projection. When the wheel 220 is positioned around the projection 218, a circumferential edge of the wheel extends outward slightly beyond the exposed surface 226 of the straight edge 216. This slight extension of the wheel 220 is operative to backset the straight edge 216 from an adjacent wall contacting the wheel when the guide is in the edging position only for trim of such height (including walls) which would contact the wheel instead of the guide surface 216. Trimming objects that are angular or shorter than the distance from the bottom edge of 216 to the top of surface 214 would only contact the guide surface 216.

Figure 2:
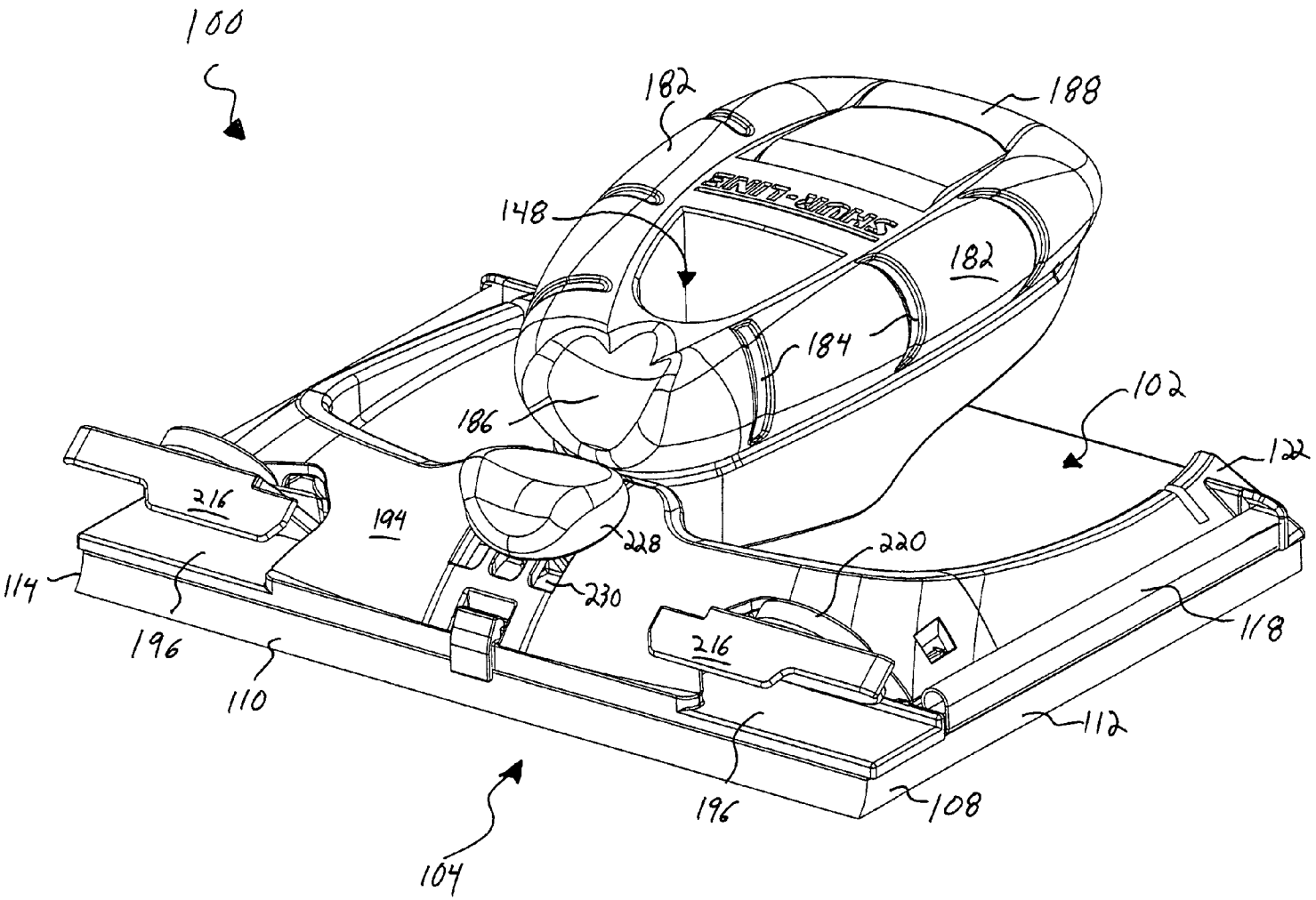
FIG. 2 is an elevated perspective view of the exemplary liquid applicator of FIG. 1, where the guide assembly in a retracted position.

Referencing FIGS. 1-9, the guide 198 is repositionable between an edging position (see FIG. 1) and a retracted position (see FIG. 2). To reposition the guide 198 from the edging position to the retracted position, a guide control button 228 is repositioned within a track 230 of the guide housing 194. The guide button 228 includes a pair of legs 232 having detents 234 that inhibit removal of legs from the track and corresponding disengagement between the button and the lever 210. A cavity 236 formed on the underside of the button 228 receives a portion of the lever 210 so that forward movement of the button repositions the lever to rotate the tubular portion 206 toward the edging position. Conversely, rearward movement of the button 228 repositions the lever 210 to rotate the tubular portion 206 toward the retracted position. The forward most position of the legs 232 within the track 230, away from the turret 124, corresponds to the edging position, while the rearmost position of the legs 232 within the track 230, positioned nearer to the turret 124, corresponds to the retracted position. It is envisioned that the edging position corresponds to a painting configuration, while the retracted position corresponds to a paint loading configuration where the guide is out of potential contact with a reservoir of paint.

It is to be understood that the designations "reusable structure" 102 and "disposable structure" 104 are only for purposes of exemplary explanation and by no means limit application of the invention to structures where the plastic backing 106 and carpet 108 is disposable and the remainder is reusable. Moreover, the invention likewise encompasses structures 102, 104 that are both disposable or both reusable. By way of example, and not limitation, the exemplary liquid applicator 100 may be utilized in painting applications where the paint comprises a latex paint or any other type of liquid or semi-solid where this applicator would work effectively. In such circumstances, both structures 102, 104 may be cleaned using polar solvents in order to prepare the applicator 100 for subsequent use. Conversely, both structures could be disposed of after a single use or replaced by a completely new structures 102, 104, regardless of the paint utilized. Those skilled in the art will readily understand that the invention encompasses the elements shown and described, whether or not the elements are characterized as disposable or not.

Figure 10:
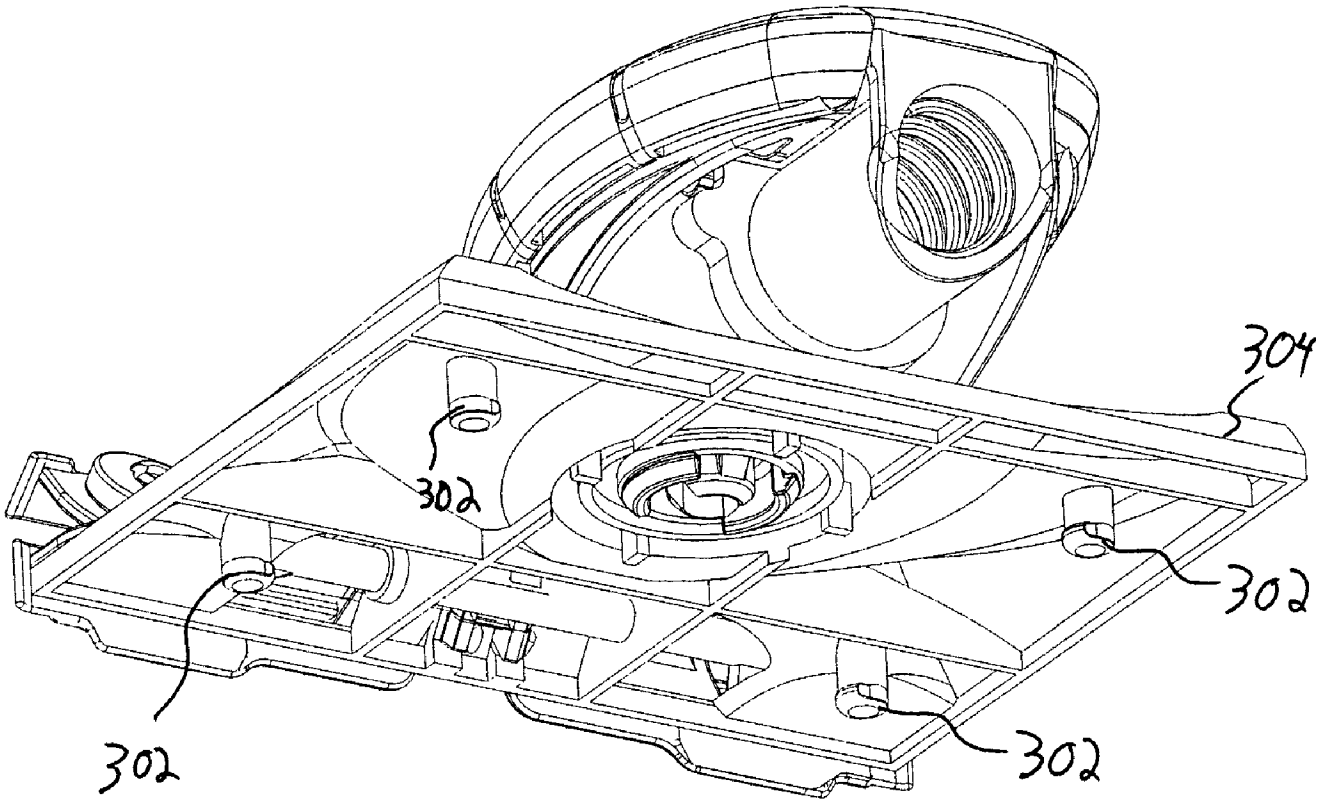
FIG. 10 is an underneath perspective view of a second exemplary liquid applicator, without an applicator pad.
Figure 11:
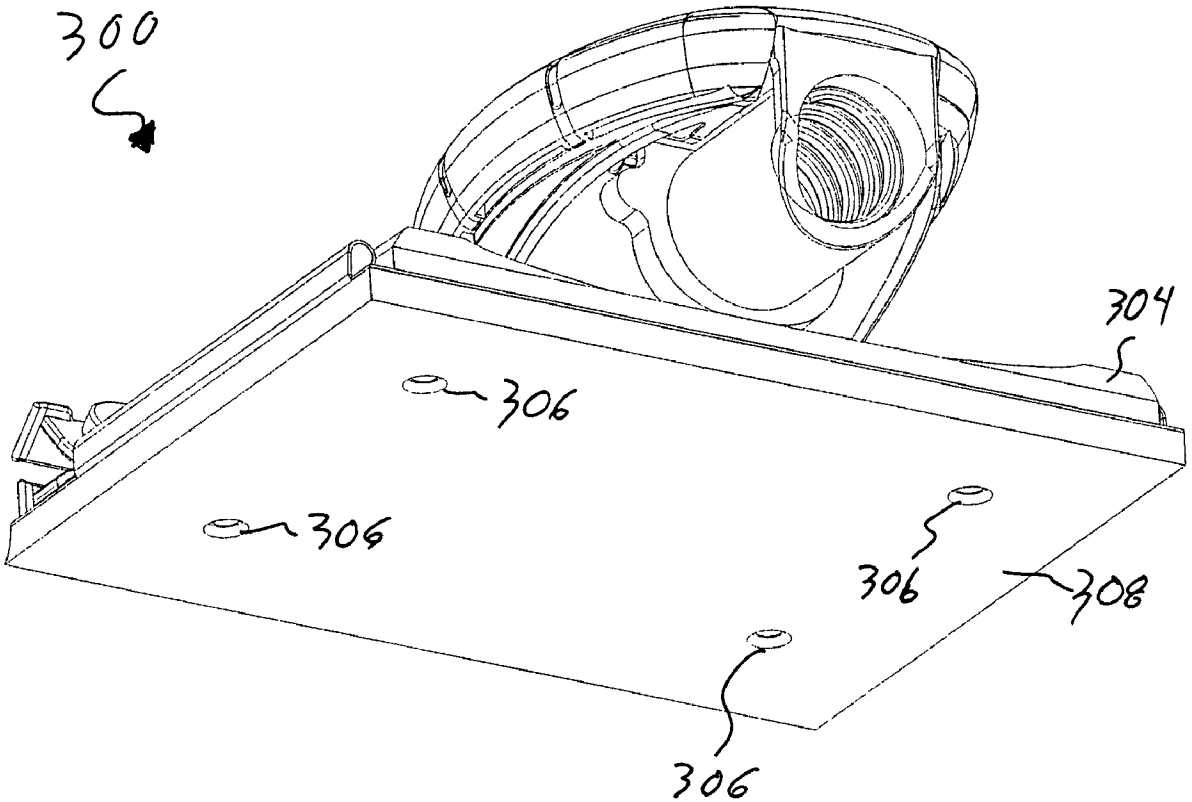
FIG. 11 is an underneath perspective view of a second exemplary liquid applicator with an applicator pad.

Referencing FIGS. 10 and 11, a second exemplary liquid applicator 300, very similar to the first exemplary applicator 100, includes pressure limiting features. In this exemplary embodiment, these pressure limiting features include four vertical posts 302 extending from the underside of a reusable structure 304. These vertical posts 302 are adapted to be vertically aligned and received within corresponding circular openings 306 formed within a disposable structure 308 for applying a liquid to a chosen surface, such as, without limitation, an interior wall of a building. In exemplary form, the liquid applicator 300 is particularly suited for painting applications and, even more so, for painting borders. In the painting arena, painting of borders around windows, doorways, and adjacent walls is initially done before the larger, remaining surfaces are painted.

The exemplary disposable structure 308 is similar in all respects, but for the circular openings 306, to the first exemplary disposable structure 104. It should be noted, however, that the circular openings 306 could alternatively be shaped in any manner that allows a projection to pierce the openings. Likewise, the reusable structure 304 is similar in all respects, but for the vertical posts 302, to the first exemplary disposable structure 102.

These vertical posts 302 are operative to limit the amount of pressure a user can apply to the disposable structure 308. Principally, when a user attempts to apply a greater amount of pressure than necessary to maintain the disposable structure 308 in contact with the substrate to which the liquid is being applied, the posts project all the way through the openings 306 and "bottom out" and contact the substrate so that excess pressure exerted by the user on the reusable structure 304 is born by the substrate rather than the disposable structure 308. Without these pressure limiting features, the disposable structure 308 would bear the pressure and generally result in excess liquid leaching out, causing drips or streaking during liquid application. Conversely, under proper pressure application conditions, the posts 302 remain recessed within the openings 306 and not in contact with the substrate so that pressure applied to the reusable structure 304 is born by the disposable structure 308 contacting the substrate.

It is to be understood, however, that alternate pressure limiting features may be incorporated into the disposable structure 308. Exemplary pressure limiting features include, without limitation, selectively placed stiffer fibers in the pad to limit the amount of travel between the wall and pad backing thereby reducing paint squeeze out, as well as embedded posts in the pad that bottom out on the wall when a predetermined pressure is exceeded. In exemplary form, the orientation of the stiffer fibers is a matter of design choice and may include incorporating stiffer fibers than those of the bulk pad, where the stiffer fibers have a height less than that of the remainder of the bulk fibers. Those skilled in the art will be familiar with the alternatives possible in view of the foregoing disclosure.

Figure 12:
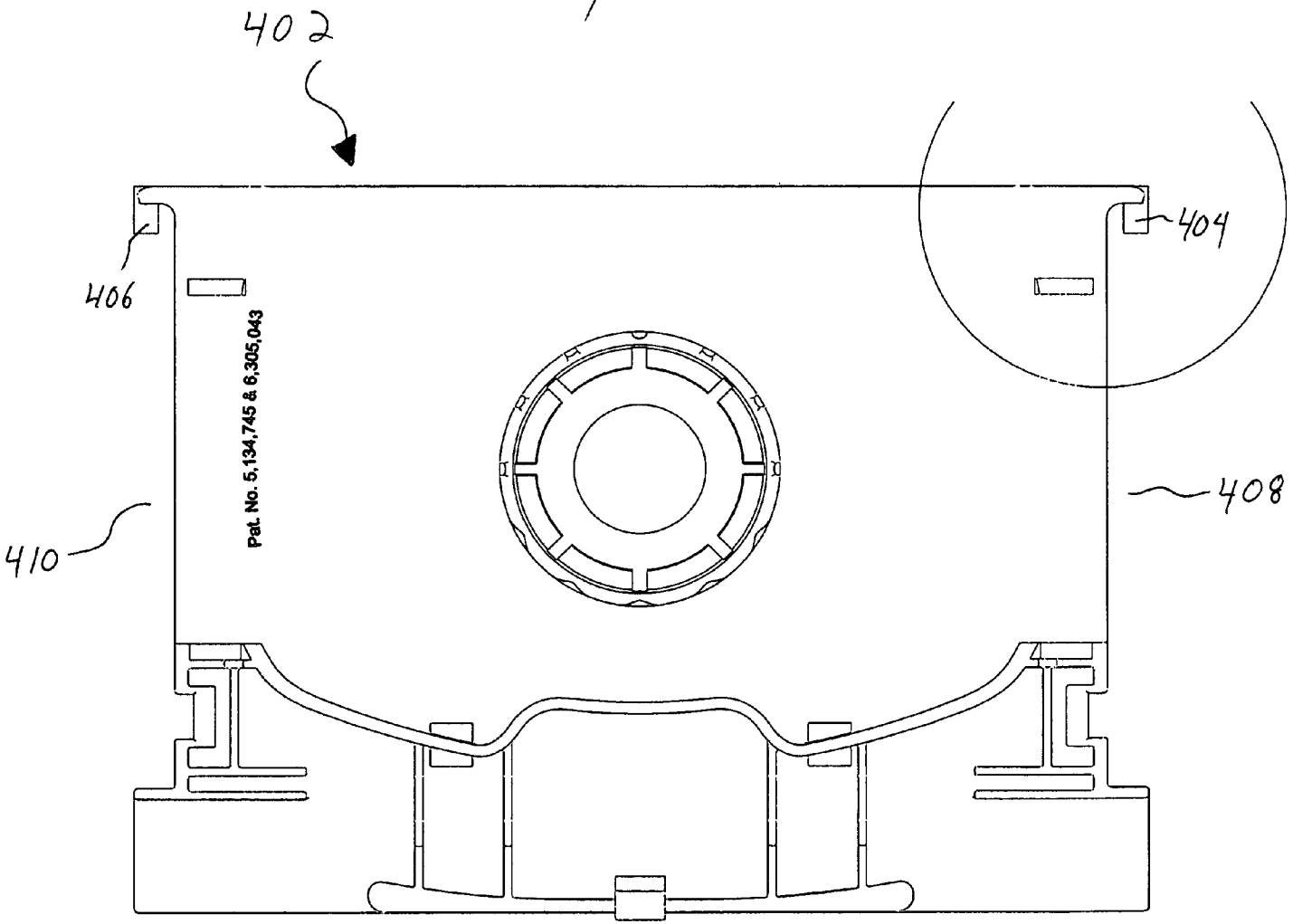
FIG. 12 is a plan view of an alternate exemplary molded frame for use in the first and second exemplary embodiments.
Figure 13:
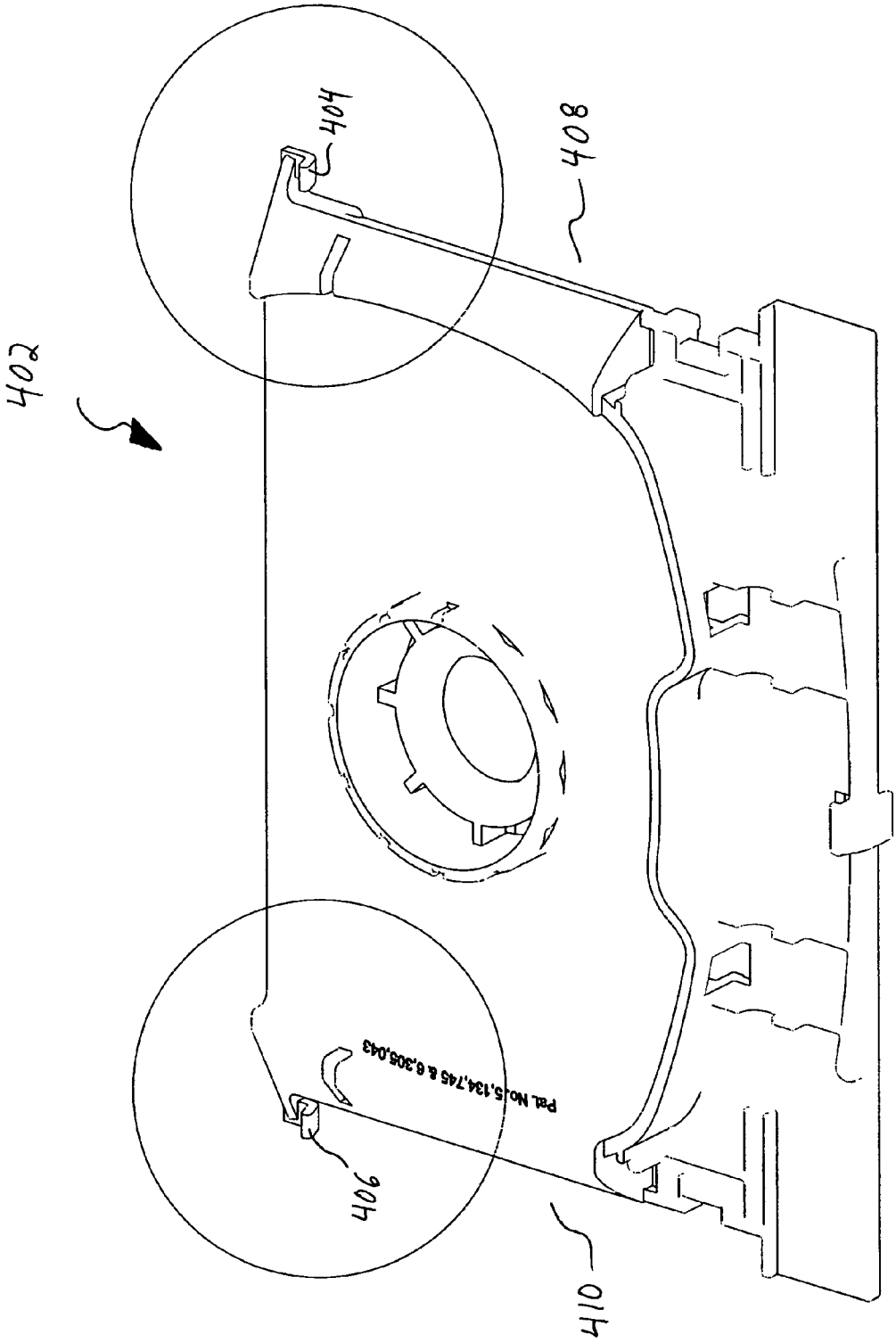
FIG. 13 is an elevated perspective view of an alternate exemplary molded frame for use in the first and second exemplary embodiments.
Figure 14:
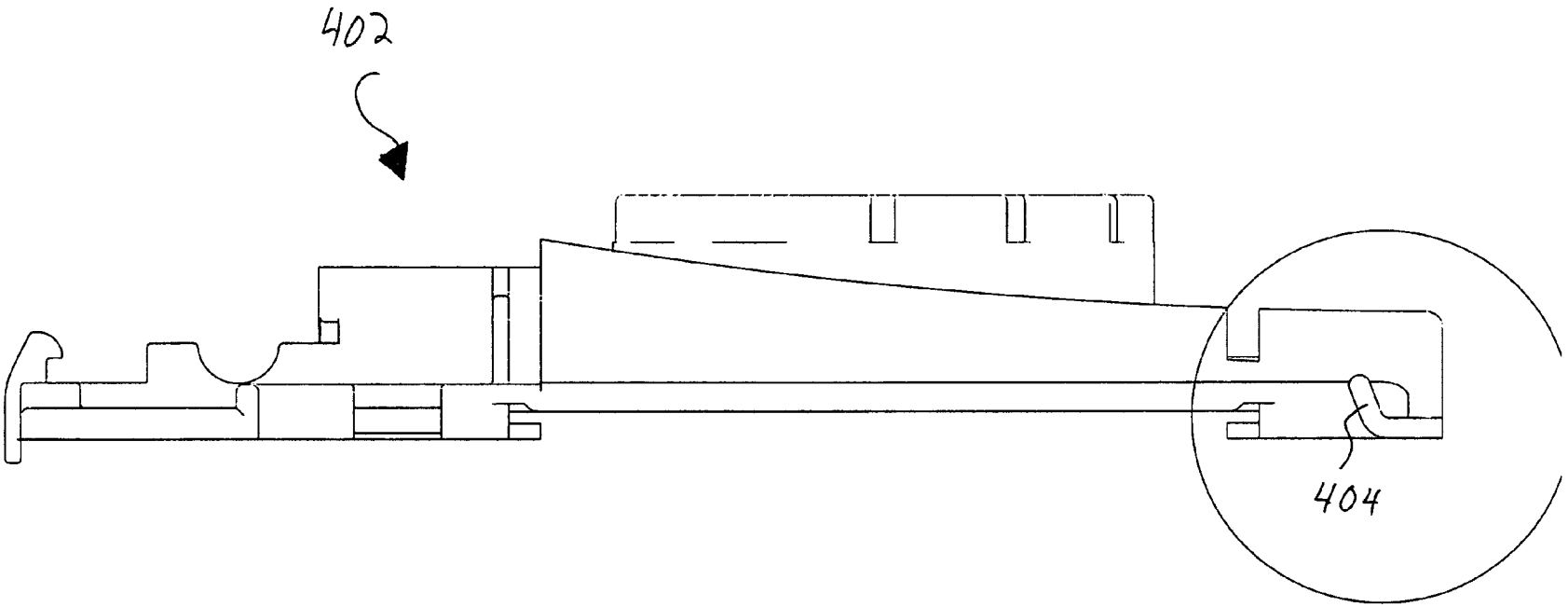
FIG. 14 is a left side profile view of an alternate exemplary molded frame for use in the first and second exemplary embodiments.

Referring to FIGS. 12-14, an alternate exemplary frame 402 for use with the first or second exemplary embodiments (in place of the molded frame 122), includes a biased arms 404, 406 projecting from a rearward portion of the frame. Each arm 404, 406 helps facilitate alignment of the frame 402 with respect to the disposable structure 104 (see FIG. 5). This initially includes vertically orienting each upstanding loop 118 of the disposable structure 104 (see FIG. 5) generally within each of the corresponding lateral cavities 408, 410 of the frame 402. When this general orientation is reached, the frame 402 and the disposable structure 104 are brought closer to one another so that any misalignment is corrected by one or both loops 118 contacting the biased arms 404, 406, which direct the loops 118 into proper orientation within the lateral cavities 408, 410 as the structures 402, 104 continue to be brought closer to one another. In this exemplary embodiment, misalignment refers to a condition where the front of the disposable structure 104 is not aligned with the front of the frame 402. Thus, the biased arms 404, 406 ensure that the front of the disposable structure 104 is aligned with the front of the frame 402 by pushing the disposable structure 104 forward by way of the loops 118.

Following from the above description and invention summaries, it should be apparent to those of ordinary skill in the art that, while the methods and apparatuses herein described constitute exemplary embodiments of the present invention, the invention contained herein is not limited to this precise embodiment and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A coating applicator comprising:

a substrate removably mounted to a frame, where the frame includes an actuator repositionable between an engaging position and a disengaging position, where the engaging position is operative to maintain the substrate in mounting engagement with the frame, where the disengaging position is operative to discontinue the substrate in mounting engagement with the frame, where the substrate includes a receptor for retaining a coating composition for application wherein the frame includes a turret rotationally repositionable with respect to the substrate and the turret includes the actuator for disengaging the substrate from the frame, wherein the actuator includes at least one lateral detent that engages a corresponding feature of the substrate when the actuator is in the engaging position; and the lateral detent is repositioned with respect to the corresponding features of the substrate when the actuator is in the disengaging position, wherein the actuator includes a deformable panel that extends laterally on the underside of the frame, where an end of the deformable panel comprises the lateral detent;

the actuator includes a projection mounted to the deformable panel that is operative to reposition the deformable panel between a substantially planar position and a substantially bowed position;

the substantially planar position corresponds to the engaging position of the actuator; and the substantially bowed position corresponds to the disengaging position of the actuator.

2. The coating applicator of claim 1, wherein:

the deformable panel slidably engages a track on the underside of the frame;

the deformable panel is repositionable between a substantially planar orientation and a substantially bowed orientation;

the substantially planar orientation corresponds to the extended position; and the substantially bowed orientation corresponds to the retracted position.

3. The coating applicator of claim 1, wherein the deformable panel includes an orifice for receiving a portion of the actuator to mount the turret to the deformable panel.

4. The coating applicator of claim 1, further comprising a repositionable guide mounted to the frame, the repositionable guide being repositionable between an edging position and a withdrawn position.

5. The coating applicator of claim 1, wherein the frame and turret cooperate to provide a ratchet comprising a toothed wheel engaged and a catch for engaging at least one tooth of the toothed wheel.

6. The coating applicator of claim 1, wherein:

the turret includes a grip; and the turret includes a proximal finger indentation.

7. The coating applicator of claim 1, wherein:

the turret is pivotally coupled to a threaded shaft receiver;

the turret is rotationally repositionable about a first axis;

the threaded shaft receiver is rotationally repositionable about a second axis; and the first axis is substantially perpendicular to the second axis.

8. The coating applicator of claim 1, wherein:

at least one of the substrate and the frame includes a force regulator regulating the force applied to the substrate from the frame.

9. The coating applicator of claim 8, wherein:

the force regulator includes at least one projection extending from the frame that extends through a corresponding opening in the substrate and is at least even with or passes beyond a plane of the substrate when the force applied to the frame exceeds a predetermined force.

10. An applicator comprising:

a frame including a receiver, an actuator, and a handle;

a substrate mounted to the substantially planar underside of the frame, the substrate including a liquid application surface having a first lateral edge angled with respect to a second lateral edge;

a guide including a straight edge, the guide being repositionably mounted to the receiver and respositionable by way of the actuator between an edging position and a withdrawn position, the guide interposing the frame and a contact surface when in the edging position wherein the frame includes a lateral detent, the lateral detent being repositionable between an extended position and a retracted position, the handle includes a detent actuator for repositioning the lateral detent from an extended position to a retracted position, and the substrate including a lateral detent receiver; wherein:

the lateral detent comprises a pair of opposed lateral detents;

the substrate comprises a pair of lateral detent receivers; and the lateral detents comprise opposed lateral ends of a deformable panel mounted to the frame.

11. The applicator of claim 10, wherein:

the deformable panel slidably engages a track on the underside of the frame;

the deformable panel is repositionable between a substantially planar orientation and a substantially bowed orientation;

the substantially planar orientation corresponds to the extended position; and the substaritially bowed orientation corresponds to the retracted position.

12. The applicator of claim 10, wherein the deformable panel includes an orifice for receiving a portion of the actuator to mount the actuator to the deformable panel.

13. The applicator of claim 10, wherein:

the handle is rotationally mounted to the frame to allow rotation of the handle independent of the frame; and the frame and the handle cooperate to provide a ratchet comprising a toothed wheel engaged and a catch for engaging at least one tooth of the toothed wheel.

14. The applicator of claim 10, wherein the substrate includes a lateral upstanding loop the cooperates with a base of the substrate to provide the detent receiver.

15. The applicator of claim 10, wherein:

the handle includes a grip; and the handle includes a proximal finger indentation.

16. The applicator of claim 10, wherein:

the handle is pivotally coupled to a threaded shaft receiver;

the handle is rotationally repositionable about a first axis;

the threaded shaft receiver is rotationally repositionable about a second axis; and the first axis is substantially perpendicular to the second axis.

17. The applicator of claim 10, wherein:

at least one of the substrate and the frame includes a force regulator regulating the force applied to the substrate from the frame.

18. The applicator of claim 17, wherein:

the force regulator includes at least one projection extending from the frame that extends through a corresponding opening in the substrate and is at least even with or passes beyond a plane of the substrate when the force applied to the frame exceeds a predetermined force.

* * * * *